US009535390B2

(12) United States Patent
Matsuno

(10) Patent No.: US 9,535,390 B2
(45) Date of Patent: Jan. 3, 2017

(54) IMAGE FORMING APPARATUS THAT PREVENTS OCCURRENCE OF FAILURE IN ASSOCIATION WITH TEMPERATURE RISE OF CIRCUIT BOARD

(71) Applicant: Kyocera Document Solutions Inc., Osaka (JP)

(72) Inventor: Akinori Matsuno, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 14/979,534

(22) Filed: Dec. 28, 2015

(65) Prior Publication Data

US 2016/0187834 A1 Jun. 30, 2016

(30) Foreign Application Priority Data

Dec. 25, 2014 (JP) ..... 2014-261912

(51) Int. Cl.
*G03G 15/00* (2006.01)
*G03G 21/16* (2006.01)
*G03G 21/20* (2006.01)

(52) U.S. Cl.
CPC ..... *G03G 15/80* (2013.01); *G03G 15/6552* (2013.01); *G03G 21/1619* (2013.01); *G03G 21/1652* (2013.01); *G03G 21/206* (2013.01); *G03G 2221/1645* (2013.01)

(58) Field of Classification Search
CPC ..... G03G 15/80; G03G 21/206; G03G 2221/1645
USPC ..... 399/88
See application file for complete search history.

(56) References Cited

U.S. PATENT DOCUMENTS 5,510,827 A * 4/1996 Kubota ..... G03G 15/326 347/257
7,469,112 B2 * 12/2008 Yuasa ..... G03G 21/206 399/92
7,486,903 B2 * 2/2009 Asakawa ..... G03G 15/5016 399/107
8,913,913 B2 * 12/2014 Kitajima ..... B41J 29/38 347/222
2003/0117477 A1 * 6/2003 Yamanaka ..... G03G 15/326 347/129
2004/0096229 A1 * 5/2004 Yoshihara ..... H05K 7/20145 399/33
2010/0124018 A1 * 5/2010 Yoshida ..... G03G 21/206 361/695

FOREIGN PATENT DOCUMENTS

JP 2005-257916 A 9/2005
JP 2010-164674 A 7/2010

* cited by examiner

*Primary Examiner* — David Gray
*Assistant Examiner* — Tyler Hardman
(74) *Attorney, Agent, or Firm* — James Judge

(57) ABSTRACT

An image forming apparatus includes an apparatus main body, a paper sheet feeder, an image forming circuit, a paper sheet discharge unit, and a high voltage circuit board. The paper sheet feeder is located in the apparatus main body to feed a sheet. The image forming circuit is located in the apparatus main body to form an image on the sheet fed by the paper sheet feeder. The image formed sheet with is discharged to the paper sheet discharge unit. The high voltage circuit board is located along a horizontal direction over the image forming circuit in the apparatus main body to supply a high voltage to the image forming circuit.

3 Claims, 9 Drawing Sheets

IMAGE FORMING APPARATUS THAT PREVENTS OCCURRENCE OF FAILURE IN ASSOCIATION WITH TEMPERATURE RISE OF CIRCUIT BOARD

INCORPORATION BY REFERENCE

This application is based upon, and claims the benefit of priority from, corresponding Japanese Patent Application No. 2014-261912 filed in the Japan Patent Office on Dec. 25, 2014, the entire contents of which are incorporated herein by reference.

BACKGROUND

Unless otherwise indicated herein, the description in this section is not prior art to the claims in this application and is not admitted to be prior art by inclusion in this section.

An image forming apparatus that forms an image on a sheet has been proposed. The image forming apparatus includes a paper sheet feeder, an image forming unit, and a paper sheet discharge unit. The image forming unit forms an image on a sheet sent out from the paper sheet feeder in the image forming unit. Then, after a fixing process of the image is performed on the sheet, the sheet is discharged in a paper sheet discharge unit.

There is proposed a constitution where a high voltage circuit board that supplies a high voltage to an image forming unit is located on a sidewall of an apparatus main body of an image forming apparatus. Further, there is proposed a constitution where a high voltage circuit board and an electric power supply circuit board are located on a sidewall or bottom portion of an apparatus main body of an image forming apparatus.

SUMMARY

An image forming apparatus according to one aspect of the disclosure includes an apparatus main body, a paper sheet feeder, an image forming circuit, a paper sheet discharge unit, and a high voltage circuit board. The paper sheet feeder is located in the apparatus main body to feed a sheet. The image forming circuit is located in the apparatus main body to form an image on the sheet fed by the paper sheet feeder. The image formed sheet with is discharged to the paper sheet discharge unit. The high voltage circuit board is located along a horizontal direction over the image forming circuit in the apparatus main body to supply a high voltage to the image forming circuit.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
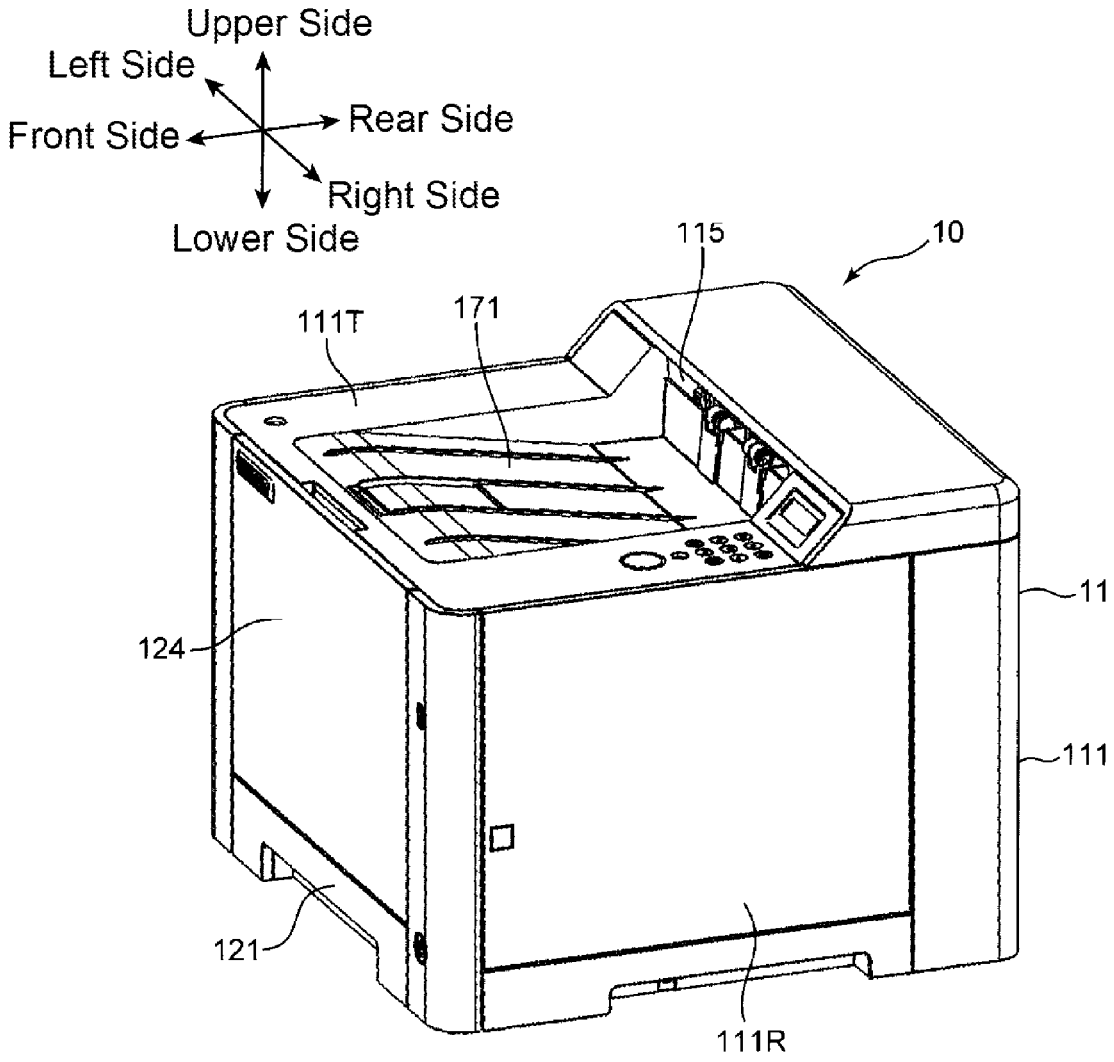
FIG. 1 obliquely illustrates an image forming apparatus according to an embodiment of the disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be located, substituted, combined, separated, and designed in a wide variety of different configurations, all of which are explicitly contemplated herein.

The following describes an image forming apparatus 10 according to an embodiment of the disclosure in detail based on the accompanying drawings. This embodiment exemplifies a tandem type color printer as an exemplary image forming apparatus. The image forming apparatus may be devices such as a copier, a facsimile device, and a multifunctional peripheral of these devices.

Figure 2:
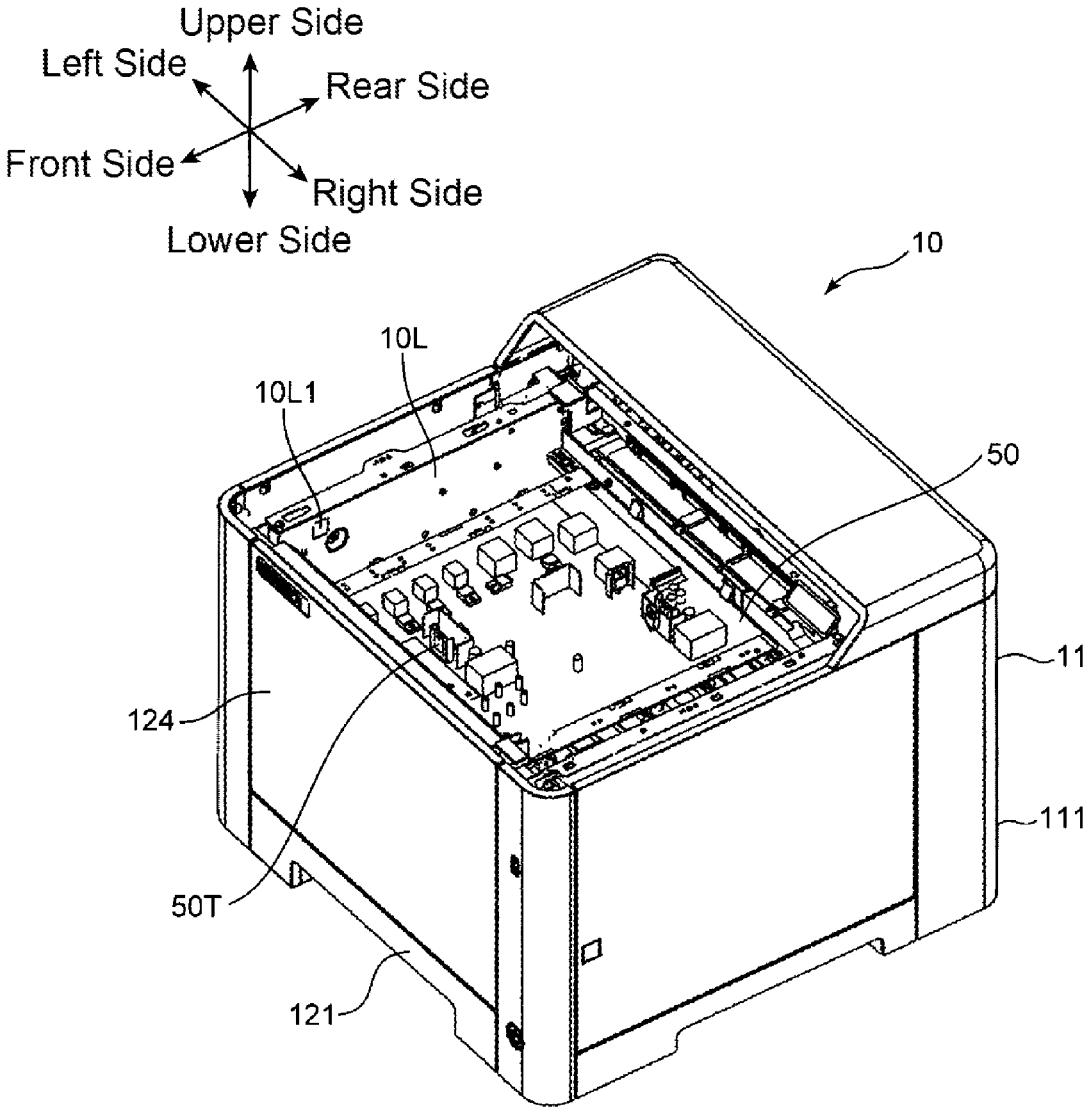
FIG. 2 obliquely illustrates an internal state of an image forming apparatus according to one embodiment.
Figure 3:
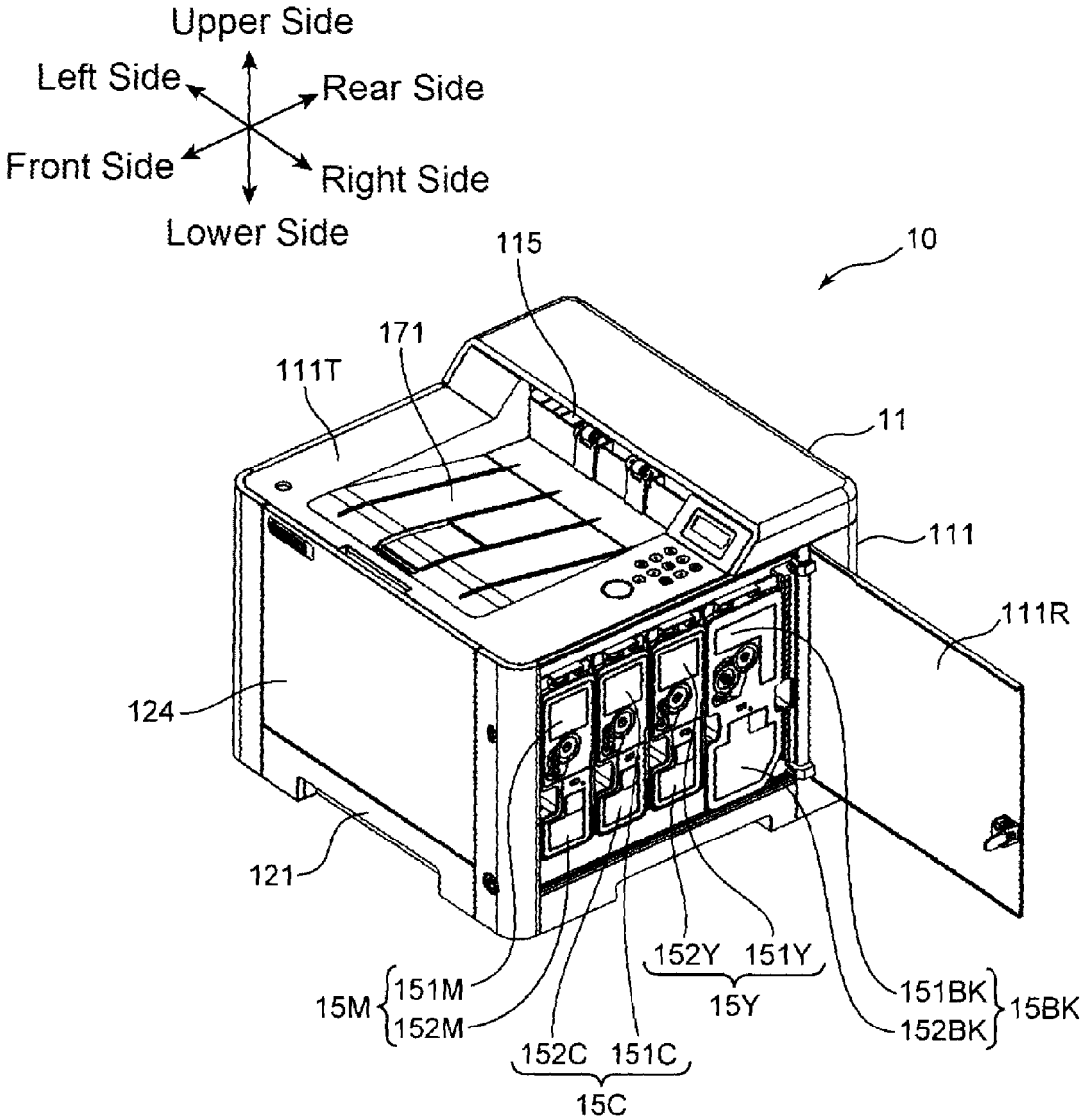
FIG. 3 obliquely illustrates a state where a cover of the image forming apparatus according to the one embodiment is opened.
Figure 4:
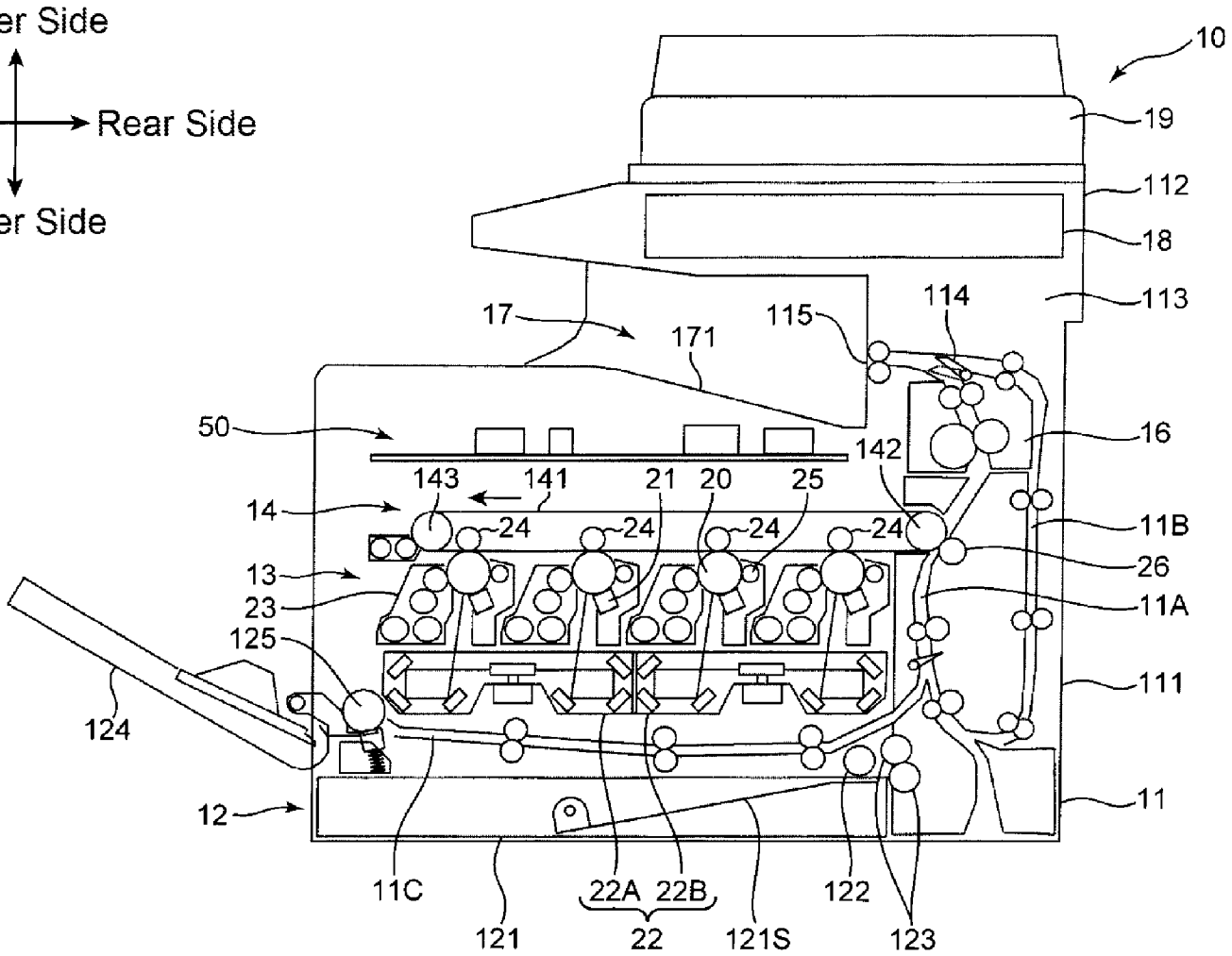
FIG. 4 illustrates a cross section of an internal structure of the image forming apparatus according to the one embodiment.

FIG. 1 obliquely illustrates the image forming apparatus 10 according to the embodiment. FIG. 2 obliquely illustrates an internal state of the image forming apparatus 10 according to the embodiment. FIG. 3 obliquely illustrates a state where a right side cover 111R of the image forming apparatus 10 according to the embodiment is opened. FIG. 4 illustrates a cross section of an internal structure of the image forming apparatus 10 according to the embodiment. The image forming apparatus 10 includes a box-shaped housing 11. The housing 11 includes a lower chassis 111 (apparatus main body), an upper chassis 112, and a connection chassis 113. In FIG. 1 to FIG. 3, illustrations of the upper chassis 112 and the connection chassis 113 are omitted. The lower chassis 111 defines a lower portion of the housing 11 and has an approximately rectangular shape. The upper chassis 112 is a flat-shaped housing located at intervals over the lower chassis 111. The connection chassis 113 connects the lower chassis 111 and the upper chassis 112 in a vertical direction in their respective left end portions and respective rear end portions. A paper sheet discharge unit 17 is formed between the lower chassis 111 and the upper chassis 112, ahead of the connection chassis 113. A sheet with an image formed is discharged in the paper sheet discharge unit 17.

An operation unit is located for performance of input operation of output condition or similar condition relative to a sheep P, in a right side portion of a top surface portion of the lower chassis 111 (FIG. 1). There are located a power key and various kinds of operation keys for input of the output conditions in this operation unit. The lower chassis 111 includes a top surface cover 111T. The top surface cover 111T is a plate-shaped member constituting a part of the top surface portion of the lower chassis 111 and removably attached to the lower chassis 111. Removing the top surface cover 111T from the lower chassis 111 exposes the inside of the lower chassis 111, as illustrated in FIG. 2. This exposes a high voltage circuit board unit 50, which will be described later, outside the lower chassis 111. The paper sheet discharge unit 17 includes a sheet discharge tray 171. The top surface portion of the lower chassis 111, in other words, the top surface cover 111T defines the sheet discharge tray 171. On the sheet discharge tray 171 is loaded a sheet with an image formed. The sheet discharge tray 171 includes an inclined surface lowering forward, toward an upstream side from a downstream side in a discharge direction of the sheet with an image formed (FIG. 4).

Referring to FIG. 4, a main conveyance path 11A, a duplex conveyance path 11B, and a manual paper feed conveyance path 11C extend as conveyance paths, which convey a sheet, inside the lower chassis 111. The main conveyance path 11A passes through a secondary transfer nip area between an intermediate transfer unit 14 and a secondary transfer roller 26, and a fixing unit 16 from a paper sheet feeder 12, which will be described later, and conveys a sheet up to the upper portion of the lower chassis 111. As illustrated in FIG. 4, a plurality of conveyance roller pairs are located in the main conveyance path 11A.

A switching unit 114 and a sheet discharge exit 115 are formed on the upper end portion of the lower chassis 111. The switching unit 114 switches a conveyance direction of a sheet. The sheet having been conveyed in the main conveyance path 11A is discharged in the paper sheet discharge unit 17 from the sheet discharge exit 115. The duplex conveyance path 11B communicates with a downstream-side end portion of the main conveyance path 11A. The duplex conveyance path 11B is a conveyance path that conveys a sheet when an image is formed also on the back surface of a sheet. When the distal end portion of the sheet, where an image is formed on the surface, is exposed in the paper sheet discharge unit 17 from the sheet discharge exit 115, the switching unit 114 rotates to switch the conveyance path of the sheet. Then, the conveyance roller pair (not illustrated) reversely rotates to carry the sheet in the duplex conveyance path 11B. The sheet conveyed in the duplex conveyance path 11B is carried again in the main conveyance path 11A in the upstream side with respect to the secondary transfer nip area. This ensures forming an image on the back surface of the sheet. The manual paper feed conveyance path 11C is a conveyance path that carries a sheet conveyed from a manual bypass tray 124, which will be described later, into the main conveyance path 11A. The manual paper feed conveyance path 11C extends in the horizontal direction over a sheet feed cassette 121.

The image forming apparatus 10 includes the paper sheet feeder 12, an image forming unit (also referred to as an image forming circuit) 13, the intermediate transfer unit 14, the secondary transfer roller 26, the fixing unit 16, a reading unit 18, and an automatic document feeder (ADF) 19.

The paper sheet feeder 12 is located in the lower chassis 111 and feeds a sheet. The paper sheet feeder 12 includes the sheet feed cassette 121, a pickup roller 122, a feed roller pair 123, the manual bypass tray 124, and a manual paper feed roller 125.

The sheet feed cassette 121 is removably mounted in a lower position of the lower chassis 111 from a front, and retains a sheet bundle, where a plurality of sheets are stacked. The sheet feed cassette 121 includes a lift plate 121S internally. The rear end side of the lift plate 121S is moved upward by an elevating mechanism (not illustrated). This causes the sheet stacked on the lift plate 121S to contact with the pickup roller 122. The pickup roller 122 feeds the sheet retained in the sheet feed cassette 121. The feed roller pair 123 feeds the sheet fed by the pickup roller 122 to the main conveyance path 11A by separating the sheet one by one. The manual bypass tray 124 is a tray to place a sheet, which is fed manually. As illustrated in FIG. 4, the manual bypass tray 124 is opened from the front side surface of the lower chassis 111 when a sheet is fed manually. The manual paper feed roller 125 feeds the sheet placed in the manual bypass tray 124 to the manual paper feed conveyance path 11C.

The image forming unit 13 forms a toner image for transferring to a sheet and includes a plurality of image forming units forming different color toner images. This embodiment includes a magenta unit 13M using a magenta (M) color developer, a cyan unit 13C using a cyan (C) color developer, a yellow unit 13Y using a yellow (Y) color developer, and a black unit 13BK using a black (BK) color developer (see FIG. 6), which are sequentially located toward the downstream side from the upstream side (from the front side to the rear side in FIG. 1), in the rotation direction of the intermediate transfer belt 141, which will be described later. Each of the units 13M, 13C, 13Y, and 13Bk includes a photoreceptor drum 20, a charging apparatus 21 located in the peripheral area of the photoreceptor drum 20, a developing device 23, and a cleaning apparatus 25, respectively. An exposure apparatus 22 for exposure of the photoreceptor drum 20 of the respective units 13M, 13C, 13Y, and 13Bk is located under the image forming unit. The exposure apparatus 22 includes a first exposure unit 22A and a second exposure unit 22B. The first exposure unit 22A irradiates a laser beam that corresponds to image information on circumference surfaces of the photoreceptor drums 20 of the magenta unit 13M and the cyan unit 13C. The second exposure unit 22B irradiates a laser beam that corresponds to image information on the circumference surfaces of the photoreceptor drums 20 of the yellow unit 13Y and black unit 13BK.

The photoreceptor drum 20 is rotatably driven around its shaft, and an electrostatic latent image and a toner image are formed on the circumference surface of the photoreceptor drum 20. As the photoreceptor drum 20, a photoreceptor drum using an amorphous silicon (a-Si)-based material can be employed. As illustrated in FIG. 4, the photoreceptor drum 20 is located corresponding to the image forming unit of the respective colors, respectively. The charging apparatus 21 uniformly electrostatically charges the surface of the photoreceptor drum 20. As the charging apparatus 21, a charging apparatus by a contact electrification system can be employed. The contact electrification system includes a charging roller and an electrostatic charge cleaning brush for removing the toner attached to the charging roller. The cleaning apparatus 25 cleans the circumference surface of the photoreceptor drum 20 after transfer of a toner image.

The developing device 23 supplies toner on the circumference surface of the photoreceptor drum 20 for development of the electrostatic latent image formed on the photoreceptor drum 20. The developing device 23 uses a two-component developer made from toner and a carrier, and includes two agitation rollers, a magnetic roller, and a developing roller. The agitation roller performs circulatory conveyance while stirring the two-component developer and thus electrostatically charges the toner. The circumference surface of the magnetic roller carries the two-component developer, and the circumference surface of the developing roller carries a toner layer formed by hand-over of the toner due to an electric potential difference between the magnetic roller and the developing roller. The toner on the developing roller is supplied to the circumference surface of the photoreceptor drum 20, and thus the electrostatic latent image is developed.

The intermediate transfer unit 14 is located over the image forming unit 13. Referring to FIG. 4, the intermediate transfer unit 14 includes an intermediate transfer belt 141, a drive roller 142, a driven roller 143, and a plurality of primary transfer rollers 24.

The intermediate transfer belt 141 is an endless belt-shaped rotator and is suspended across the drive roller 142 and the driven roller 143 such that its circumference surface side is brought into contact with the circumference surface of the respective photoreceptor drums 20, respectively. The intermediate transfer belt 141 is circularly driven in one direction (an arrow direction in FIG. 4), and carries the toner image transferred from the photoreceptor drum 20 on its surface. The intermediate transfer belt 141 is a conductive soft belt with a laminated structure made of a base layer, an elastic layer, and a coat layer.

The drive roller 142 stretches the intermediate transfer belt 141 in the rear end side of the intermediate transfer unit 14 and causes the intermediate transfer belt 141 to be circularly driven. The driven roller 143 stretches the intermediate transfer belt 141 in the front end side of the intermediate transfer unit 14. The driven roller 143 gives tension to the intermediate transfer belt 141.

The primary transfer roller 24 primarily transfers the toner image on the photoreceptor drum 20 on the intermediate transfer belt 141. As illustrated in FIG. 4, the primary transfer roller 24 is located facing to the photoreceptor drum 20 of the respective colors, respectively. This ensures formation of a primary transfer nip area of the respective colors between the respective photoreceptor drums 20 and the respective primary transfer rollers 24 by sandwiching the intermediate transfer belt 141.

The secondary transfer roller 26 is located facing to the drive roller 142 while sandwiching the intermediate transfer belt 141. The secondary transfer roller 26 forms the secondary transfer nip area by being brought into contact with the circumference surface of the intermediate transfer belt 141. The toner image primarily transferred on the intermediate transfer belt 141 is secondarily transferred to a sheet supplied from the paper sheet feeder 12, in the secondary transfer nip area.

The fixing unit 16 includes a fixing roller with an internal heating source and a pressure roller that forms a fixing nip area being located facing the fixing roller. The sheet supplied to the fixing unit 16 is heated and pressured by passing the fixing nip area. This ensures fixing of the toner image, which has been transferred onto the sheet in the secondary transfer nip area, to the sheet.

The reading unit 18 is located inside the upper chassis 112. The reading unit 18 reads an image of a document sheet, which is sent out from the ADF 19, or is placed on a contact glass (not illustrated). The ADF 19 feeds a document sheet toward a reading position formed on the contact glass.

Further, the image forming apparatus 10 includes a left side frame 10L, a right side frame 10R, a first connection frame 10F, a second connection frame 10G, a bottom portion frame 10B, a unit frame 10M, a conveyance unit 27, and the high voltage circuit board unit 50. The image forming apparatus 10 includes a magenta toner unit 15M, a cyan toner unit 15C, a yellow toner unit 15Y, and a black toner unit 15BK.

Figure 5:
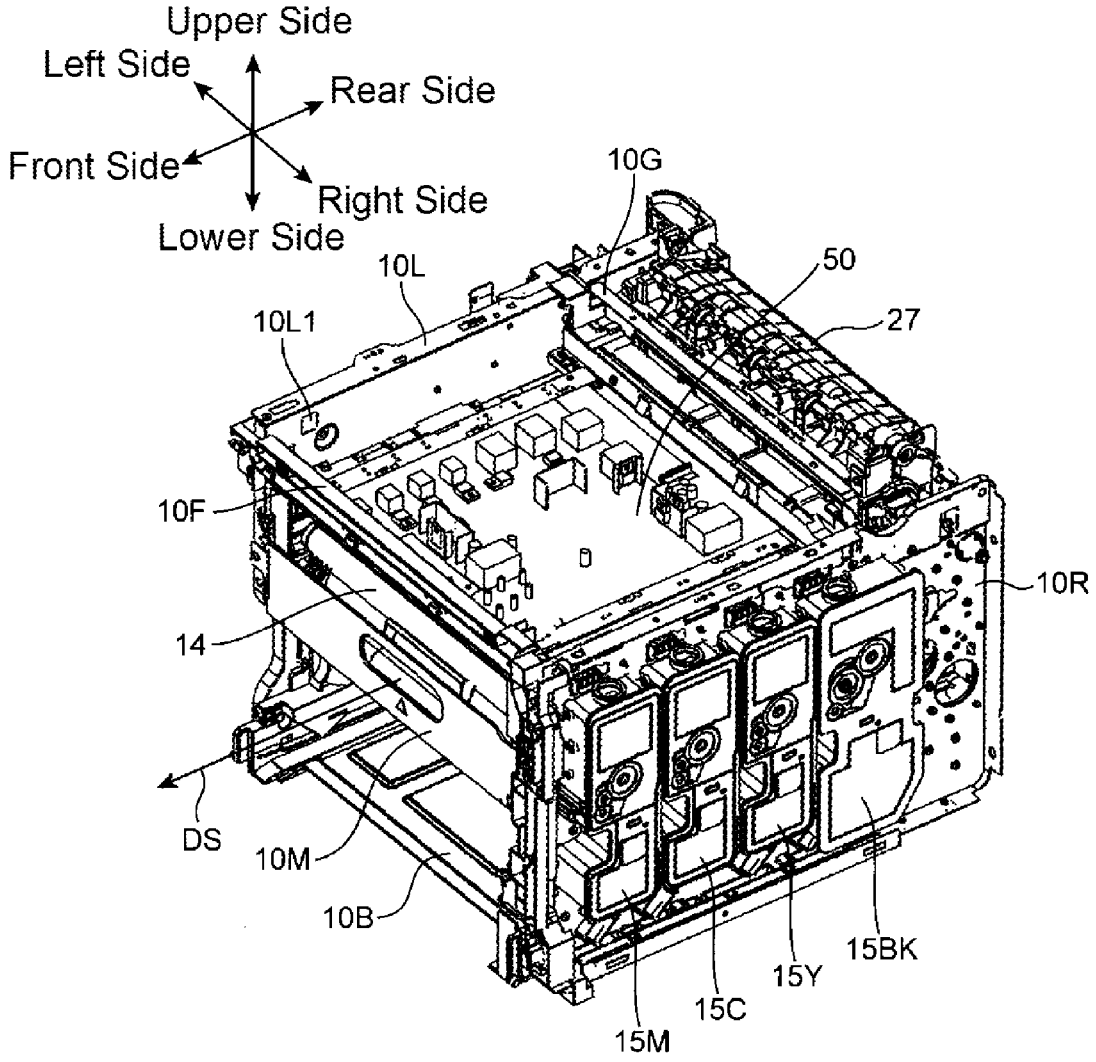
FIG. 5 obliquely illustrates the internal structure of the image forming apparatus according to the one embodiment.

FIG. 5 obliquely illustrates a state where an exterior cover of the image forming apparatus 10 is removed. Referring to FIG. 5, the left side frame 10L and the right side frame 10R are plate-shaped metal frames provided upright so as to extend in the front-rear direction and the vertical direction inside the exterior cover of the image forming apparatus 10. The left side frame 10L is located in the left end portion of the image forming apparatus 10, and the right side frame 10R is located in the right end portion of the image forming apparatus 10. As illustrated in FIG. 5, the bottom portion frame 10B connects the left side frame 10L and the right side frame 10R in the lateral direction in the proximity of the bottom portion of the image forming apparatus 10. Similarly, the first connection frame 10F connects the left side frame 10L and the right side frame 10R in the lateral direction in the front end and upper end portion of the image forming apparatus 10, and the second connection frame 10G connects the left side frame 10L and the right side frame 10R in the lateral direction in the upper end portion and rear end side of the image forming apparatus 10, respectively.

The unit frame 10M is a frame that integrally support the intermediate transfer unit 14 and the image forming unit 13. The unit frame 10M is slidably supported by the left side frame 10L and the right side frame 10R. That is, in FIG. 5, pulling out the unit frame 10M in an arrow DS direction enable maintenance of the intermediate transfer unit 14 and the image forming unit 13.

The conveyance unit 27 is a unit secured to the rear of the second connection frame 10G. The downstream-side end portion of the main conveyance path 11A and the duplex conveyance path 11B are formed inside the conveyance unit 27.

The high voltage circuit board unit 50 (high voltage circuit board) is located along the horizontal direction over the image forming unit 13, in the lower chassis 111. The high voltage circuit board unit 50 is supported by the left side frame 10L and the right side frame 10R. The high voltage circuit board unit 50 has a function of supplying a high voltage to the image forming unit 13. The high voltage circuit board unit 50 includes a substrate and a plurality of electrical components fixed on the substrate.

Referring to FIG. 5, the magenta toner unit 15M, the cyan toner unit 15C, the yellow toner unit 15Y, and the black toner unit 15BK are mounted on the right-side surface of the right side frame 10R. These units are removable from the right side frame 10R. That is, as illustrated in FIG. 3, the magenta toner unit 15M, the cyan toner unit 15C, the yellow toner unit 15Y, and the black toner unit 15BK are exposed when the right side cover 111R of the lower chassis 111 is opened or closed with the rear end side as fulcrum. This enables to attach and remove these units.

Referring to FIG. 3, the magenta toner unit 15M includes a magenta toner container 151M and a magenta recovery container 152M. The magenta toner container 151M is located in the upper portion of the magenta toner unit 15M and internally houses toner of magenta color. This toner is replenished to the developing device 23 of magenta color via a replenish path (not illustrated). The magenta recovery container 152M internally houses unnecessary toner collected by the cleaning apparatus 25 from the photoreceptor drum 20 of magenta color.

Similarly, the cyan toner unit 15C includes a cyan toner container 151C and a cyan recovery container 152C. The yellow toner unit 15Y includes a yellow toner container 151Y and a yellow recovery container 152Y. Further, the black toner unit 15BK includes a black toner container 151BK and a black recovery container 152BK. These containers have an identical function with the magenta toner container 151M and the magenta recovery container 152M.

Figure 6:
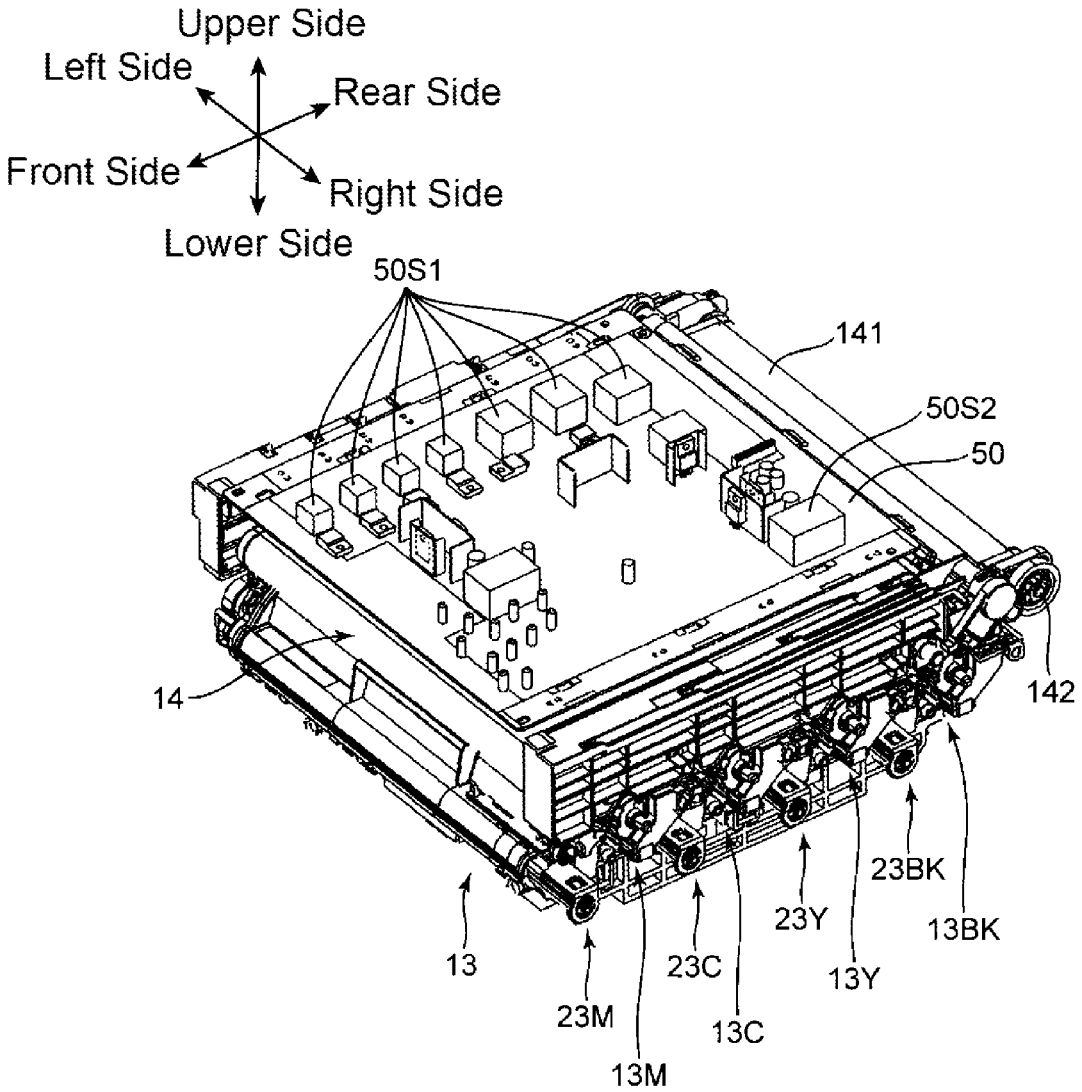
FIG. 6 obliquely illustrates a high voltage circuit board and an image forming unit in the image forming apparatus according to the one embodiment.
Figure 7:
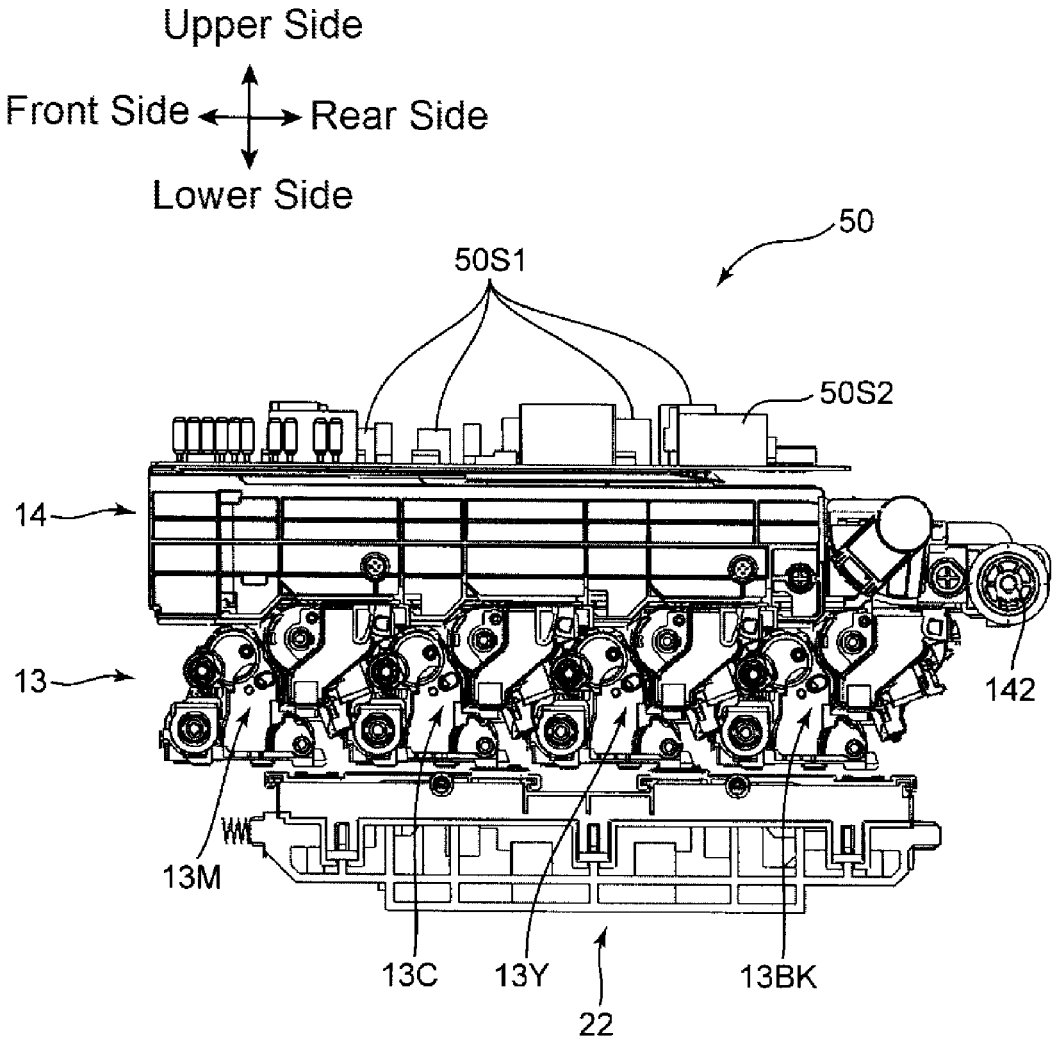
FIG. 7 illustrates a side face of the high voltage circuit board and the image forming unit in the image forming apparatus according to the one embodiment.

FIG. 6 obliquely illustrates the high voltage circuit board unit 50 and the image forming unit 13 in the inside of the image forming apparatus 10 according to the embodiment. FIG. 7 illustrates the side surface of the high voltage circuit board unit 50 and the image forming unit 13 in the image forming apparatus 10 according to the embodiment.

Referring to FIG. 6, the high voltage circuit board unit 50 includes a first electrical component 50S1 and a second electrical component 50S2. The first electrical component 50S1 is a plurality of electrical components located along the front-rear direction, in the left end side of the high voltage circuit board unit 50. The first electrical component 50S1 is a capacitor, as one example. The second electrical component 50S2 is electrical components located in the right end and rear end portion of the high voltage circuit board unit 50. The second electrical component 50S2 is also a capacitor, as one example.

Figure 8:
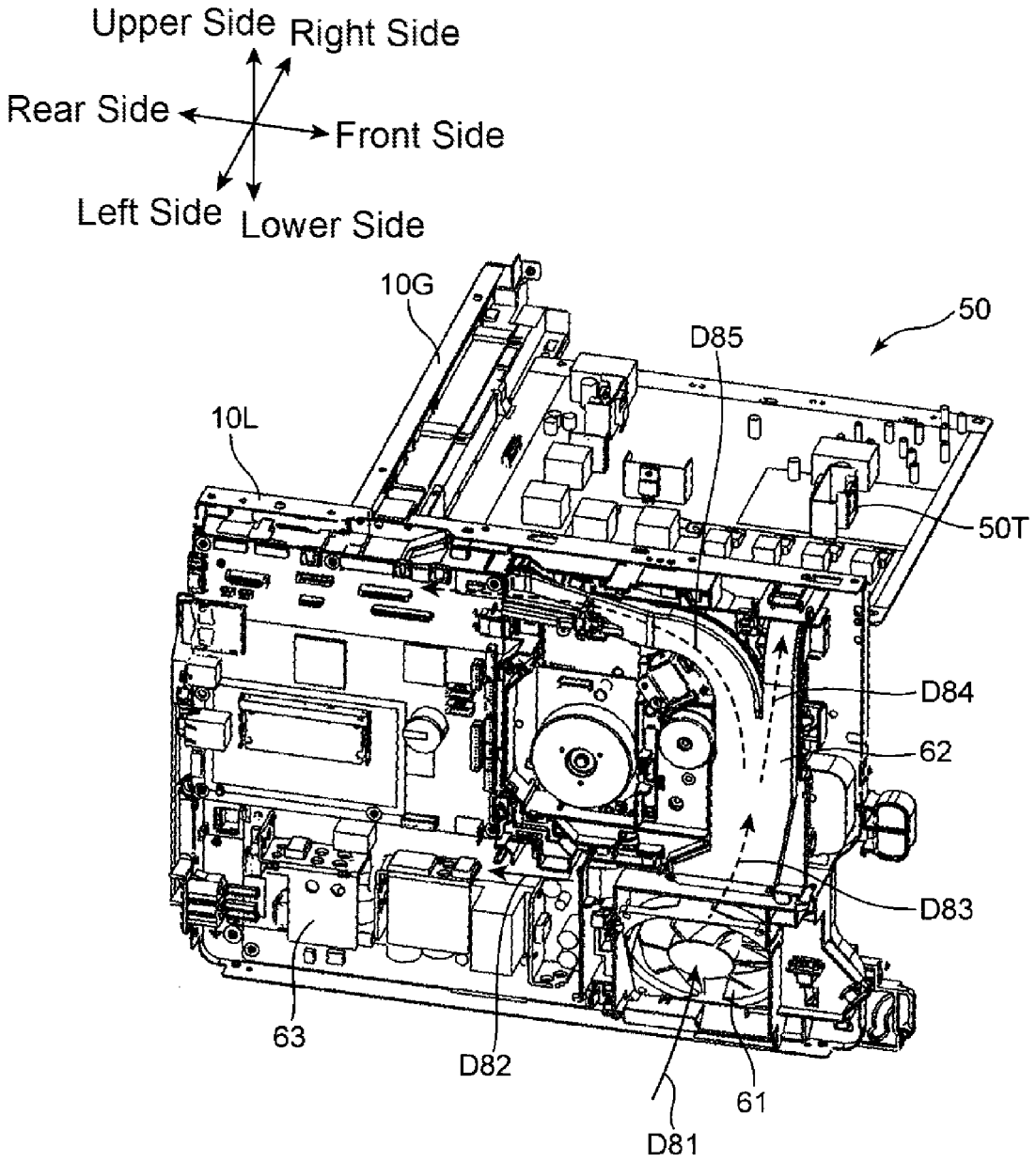
FIG. 8 obliquely illustrates flows of cooling air inside the image forming apparatus according to the one embodiment.

Further, the high voltage circuit board unit 50 includes a high voltage transformer 50T (see FIG. 2, FIG. 8). The high voltage transformer 50T is a transformer for supplying a high voltage to the image forming unit 13. The high voltage transformer 50T is located in the central region in the lateral direction, in the front end side of the high voltage circuit board unit 50.

Referring FIG. 4 to FIGS. 6 and 7, in the embodiment, the high voltage circuit board unit 50 is located along the horizontal direction over the image forming unit 13, under the sheet discharge tray 171. This prevents the heat generated in association with the temperature rise of the high voltage circuit board unit 50 from transferring to the image forming unit 13. This prevents a failure, such as fixation of the developer (toner), associated with the temperature rise of the units in the peripheral of the image forming unit 13. Especially, in the embodiment, the magenta toner unit 15M, the cyan toner unit 15C, the yellow toner unit 15Y, and the black toner unit 15BK, which internally house toner, are located in the opposite side (the right side) to the high voltage circuit board unit 50 sandwiching the right side frame 10R. This reduces transfer of the heat to the respective toner units even when the temperature of the electrical components of the high voltage circuit board unit 50 rises, and thus prevents aggregation and fixation of the toner. In this case, referring to FIGS. 5 and 6, among the electrical components mounted on the high voltage circuit board unit 50, the second electrical component 50S2, which is located in the position close to the magenta toner unit 15M, cyan toner unit 15C, yellow toner unit 15Y, and black toner unit 15BK, is lower than the first electrical component 50S1, which is located in a far position from the toner units. This further prevents the transfer of the heat to the respective toner units.

Further, as illustrated in FIG. 7, the high voltage circuit board unit 50 includes the heat generating electrical components (the first electrical component 50S1, the second electrical component 50S2) on its top surface portion. In this case, the heat generated in the high voltage circuit board unit 50 moves up by natural convection. This further prevents the generated heat from transferring to the image forming unit 13 compared with the case when the heat generating electrical components are located on the inferior surface portion of the high voltage circuit board unit 50.

Figure 9:
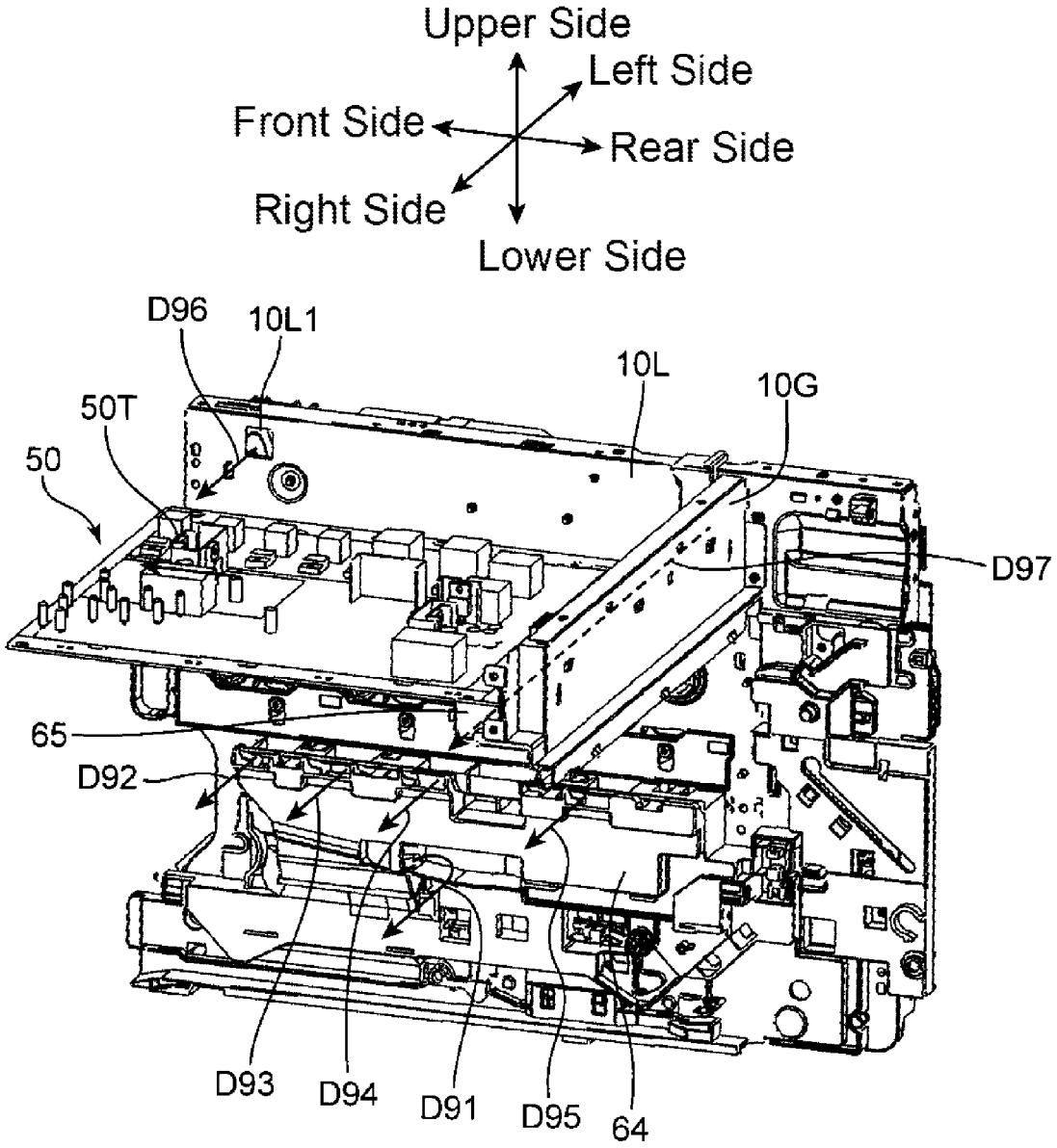
FIG. 9 obliquely illustrates the flows of the cooling air inside the image forming apparatus according to the one embodiment.

Further, FIGS. 8 and 9 obliquely illustrate flows of cooling air inside the image forming apparatus 10 according to the embodiment. FIG. 8 obliquely illustrates the left side frame 10L, the second connection frame 10G, and the high voltage circuit board unit 50 inside the image forming apparatus 10 from the left side. FIG. 9 obliquely illustrates the left side frame 10L, the second connection frame 10G, and the high voltage circuit board unit 50 inside the image forming apparatus 10 from the right side.

The image forming apparatus 10 further includes a fan 61 (air flow generation portion), a first duct 62 (duct portion), an electric power supply unit 63, a second duct 64, and a third duct 65.

The fan 61 is controlled for rotation by a control unit (not illustrated) and generates an airflow inside the lower chassis 111. The first duct 62 is a duct member made of resin and is mounted on the left side surface of the left side frame 10L. The first duct 62 guides the airflow generated by the fan 61. As illustrated in FIG. 8, the upper end portion (downstream side of the flow of the airflow) of the first duct 62 branches into two air ducts. The electric power supply unit 63 is located in the lower end and rear end portion of the left side frame 10L. The electric power supply unit 63 generates electric power consumed inside the image forming apparatus 10. The second duct 64 is a duct extending in the front-rear direction, in the lower portion of the left side frame 10L. The third duct 65 is a cooling air duct extending in the lateral direction inside the second connection frame 10G.

The left side frame 10L includes an air outlet 10L1 (blowout port) as illustrated in FIGS. 2, 5, and 9. The air outlet 10L1 is a rectangular-shaped opening that opens in the front end portion of the left side frame 10L, over the high voltage circuit board unit 50. The air outlet 10L1 communicates with the upper end portion of the first duct 62 (FIG. 8). The air outlet 10L1 has a function causing the airflow generated by the fan 61 to flow in between the sheet discharge tray 171 and the high voltage circuit board unit 50. The air outlet 10L1 is located in the left side frame 10L such that the air outlet 10L1 is positioned under the downstream side portion in the sheet discharge direction of the sheet discharge tray 171. In other words, the upper end portion of the inclined surface of the sheet discharge tray 171 is positioned over the air outlet 10L1. The above-described high voltage transformer 50T is located in the downstream side of the flow of the airflow (an arrow D96 in FIG. 9) blown out of the air outlet 10L1.

Next, referring to FIGS. 8 and 9, the following further describes the flow of the airflow generated by the fan 61 inside the image forming apparatus 10. Referring to FIG. 8, rotation of the fan 61 causes the airflow to flow toward the inside of the image forming apparatus 10 from the outside of the image forming apparatus 10 (an arrow D81 in FIG. 8). A division wall (not illustrated) guides a part of the airflow rearward (an arrow D82). This airflow blows on the electric power supply unit 63 to prevent temperature rise of the electric power supply unit 63.

Further, a part of the airflow generated by the fan 61 flows in the first duct 62 (an arrow D83). A part of this airflow flows in the second duct 64 in FIG. 9 via an opening (not illustrated) formed in the left side frame 10L. Then, a part of the airflow is guided toward the right side, as illustrated by an arrow D91. This airflow cools the exposure apparatus 22. Further, the part of the airflow having flown in the second duct 64 is guided toward the right side, as illustrated by the arrows D92, D93, D94, and D95. These four flows of the airflow cool the image forming circuits 13 of magenta, cyan, yellow, and black colors, respectively.

The airflow having moved up inside the first duct 62 is divided along the shape of the first duct 62 without flowing in the second duct 64. One airflow among the airflow moves up, as illustrated by an arrow D84 in FIG. 8, and then is blown out of the air outlet 10L1 to the right side (an arrow D96 in FIG. 9). This airflow flows toward a direction perpendicular to (intersects with) the discharge direction, where a sheet is discharged in the paper sheet discharge unit 17, and flows in between the sheet discharge tray 171 and the high voltage circuit board unit 50. Then, this airflow moves rearward along the inclined surface (FIG. 4) of the sheet discharge tray 171 while cooling the high voltage transformer 50T and the first electrical component 50S1. Then, after cooling the second electrical component 50S2, this airflow is diffused via a gap (not illustrated) inside the image forming apparatus 10, and consequently exhausted outside the image forming apparatus 10. As described above, the airflow blown out of the air outlet 10L1 flows between the sheet discharge tray 171 and the high voltage circuit board unit 50, and thus the airflow can cool not only the high voltage circuit board unit 50 but also the discharged sheet via the sheet discharge tray 171. Using the inclined shape of the sheet discharge tray 171 can guide the airflow up to the upstream side in the discharge direction of the sheet discharge tray 171. The high voltage transformer 50T, which easily become high temperature, is stably cooled by the blown airflow because the high voltage transformer 50T is located in the right side of the air outlet 10L1. Further, the airflow blown out of the air outlet 10L1 is blown out toward the direction intersecting with the sheet discharge direction. This ensures causing the airflow to diffuse in a wider range compared with a case where the airflow flows in between the sheet discharge tray 171 and the high voltage circuit board unit 50 along the sheet discharge direction. In other words, if the air outlet 10L1 opens facing toward the rear side, the airflow, which is blown out, may promptly flow linearly toward the upstream side in the discharge direction of the sheet discharge tray 171. This may reduce cooling effect for the electrical component neighboring in the lateral direction with respect to the air outlet 10L1.

Referring to FIG. 9, the second connection frame 10G is provided upright in the rear of the high voltage circuit board unit 50. The second connection frame 10G partitions the high voltage circuit board unit 50 and the fixing unit 16 (FIG. 4) in the front-rear direction. This prevents high temperature heat generated by the fixing unit 16 from affecting the high voltage circuit board unit 50 side.

In FIG. 8, among the airflow having moved up inside the first duct 62, the airflow except the airflow guided toward the air outlet 10L1 is guided in the rear side of the left side frame 10L, as illustrated by an arrow D85. Eventually, the flow of the airflow collides to a division wall (not illustrated) and then is diverted to the right side. Then, this airflow cools the fixing unit 16 while flowing inside the third duct 65, as illustrated by an arrow D97 in FIG. 9.

Although the image forming apparatus 10 according to the one embodiment of the disclosure has been described above in detail, the disclosure is not limited to this. The disclosure can employ, for example, the following modification.

(1) Although the aforementioned embodiment has described an aspect that the direction where the airflow is blown out of the air outlet 10L1 intersects with the sheet discharge direction, the disclosure is not limited to this. The following aspect may be effective: the direction where the airflow is blown out of the air outlet 10L1 is set so as to flow along the sheet discharge direction.

(2) Although the aforementioned embodiment has described that the air outlet 10L1 opens in the position close to the upper end side of the inclined surface of the sheet discharge tray 171, the disclosure is not limited to this. The air outlet 10L1 may open in the position close to the lower end side of the inclined surface of the sheet discharge tray 171.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An image forming apparatus comprising:

an apparatus main body;

a paper sheet feeder located in the apparatus main body to feed a sheet;

an image forming circuit located in the apparatus main body to form an image on the sheet fed by the paper sheet feeder;

a paper sheet discharge unit to which the image formed sheet is discharged, the paper sheet discharge unit including a sheet discharge tray for loading the image formed sheet, the sheet discharge tray being defined by the top surface portion of the apparatus main body, and having an inclined surface lowering forward toward an upstream side from a downstream side in a discharge direction of the sheet;

a high voltage circuit board located under the sheet discharge tray and along a horizontal direction over the image forming circuit in the apparatus main body, to supply a high voltage to the image forming circuit, the high voltage circuit board including a heat generating electrical component on a top surface portion of the high voltage circuit board;

an air flow generation portion that generates airflow inside the apparatus main body;

a duct portion that guides the airflow generated by the air flow generation portion; and an air outlet located under the downstream side in the discharge direction of the sheet discharge tray, and being communicated with the duct portion to cause the airflow to flow in between the sheet discharge tray and the high voltage circuit board.

2. An image forming apparatus comprising:

an apparatus main body;

a paper sheet feeder located in the apparatus main body to feed a sheet;

an image forming circuit located in the apparatus main body to form an image on the sheet fed by the paper sheet feeder;

a paper sheet discharge unit to which the image formed sheet is discharged, the paper sheet discharge unit including a sheet discharge tray for loading the image formed sheet, the sheet discharge tray being defined by the top surface portion of the apparatus main body;

a high voltage circuit board located under the sheet discharge tray and along a horizontal direction over the image forming circuit in the apparatus main body, to supply a high voltage to the image forming circuit;

the high voltage circuit board includes a heat generating electrical component on the top surface portion of the high voltage circuit board;

an air flow generation portion that generates airflow inside the apparatus main body;

a duct portion that guides the airflow generated by the air flow generation portion; and an air outlet communicated with the duct portion to cause the airflow to flow in between the sheet discharge tray and the high voltage circuit board; wherein the high voltage circuit board includes a high voltage transformer located in a downstream side of the flow of the airflow blown out of the air outlet.

3. The image forming apparatus according to claim 1, wherein the air outlet causes the airflow to flow in between the sheet discharge tray and the high voltage circuit board by causing the airflow to flow toward a direction intersecting with the discharge direction.

* * * * *